US006561956B1

(12) United States Patent
Allison

(10) Patent No.: US 6,561,956 B1
(45) Date of Patent: May 13, 2003

(54) DYNAMIC ACTIVE RESISTANCE TRAINING SYSTEM

(76) Inventor: Kasper Allison, 99 La Vuelta Rd., Montecito, CA (US) 93108

( * ) Notice: Subject to any disclaimer, the term of this patent is extended or adjusted under 35 U.S.C. 154(b) by 250 days.

(21) Appl. No.: 09/655,088

(22) Filed: Sep. 5, 2000

(51) Int. Cl.[7] ..... A63B 21/06
(52) U.S. Cl. ..... 482/94; 482/122; 482/129
(58) Field of Search ..... 482/98, 99, 129, 482/121, 122, 123, 94

(56) References Cited

U.S. PATENT DOCUMENTS 4,358,107 A * 11/1982 Nissen ..... 482/127
4,749,184 A * 6/1988 Tobin ..... 482/129
6,336,894 B1 * 1/2002 Kestila ..... 482/108

* cited by examiner

*Primary Examiner*—Nicholas D. Lucchesi
*Assistant Examiner*—Tam Nguyen
(74) *Attorney, Agent, or Firm*—William W. Haefliger

(57) ABSTRACT

The combination with liftable apparatus, including at least one weight, includes an assembly comprising at least one generally upright guide or housing supported by a base to extend near at least one weight, at least one elongated cord extending in proximity to the guide, or within the housing, the cord being resiliently stretchable and having a lower end retained relative to the base, the cord having an upper end portion configured to be lifted with the weight, whereby when said assembly is lifted, the cord becomes resiliently stretched to resist such lifting. Multiple such cords can be provided to extend in parallel, and may be coded as by color, for cord selection to provide selected added resistance to weight lifting.

20 Claims, 3 Drawing Sheets

DYNAMIC ACTIVE RESISTANCE TRAINING SYSTEM

BACKGROUND OF THE INVENTION

This invention relates generally to muscular strength enhancement and training, and more particularly to highly advantageous and simple training apparatus, and methods, embodying a number of unusual advantages.

In strength training there is always a search for ways to increase muscular power and strength. Machines have been designed to work every different muscle either through isolation of one muscle at a time or through working entire muscle groups. Machines have recently been built with selectorized weight stacks, allowing the user to select the amount of active weight with an easy pin adjustment. These machines offer good resistance when used in a slow manner, but have no way of keeping their resistance constant when an element of speed is present. Momentum is the result of speed with these machines. When momentum is present there is no work involved in the muscle negating the purpose of the machine. Also, momentum can be of high risk to muscles when changing the direction of weight imposition causing muscle tears.

Speed in movement present more "real life" to the machine user, since movement tends to be of a ballistic nature. As humans we walk, run, and play at sports, which require quick muscle contractions (concentric and eccentric). We do not move in slow motion, so it is more effective to train the body in such a way that it is more accustomed to our way of life. The limiting factor to training in this manner is the factor of momentum. In standard weight machines there is nothing to control this factor. There is need for control of this factor and for changing the way people strength-train, setting new standards.

SUMMARY OF THE INVENTION

It is a major object of the invention to provide apparatus and method to meet the above need. Basically, what is provided is a dynamic active resistance training attachment to a weight lifting system that will alleviate momentum, allowing the body to strength-train is a way that is safe, emulating more "real life" movements.

It is a further object to provide an assembly in association with at least one weight, the assembly comprising:

a) at least one generally upright guide supported by a base to extend near said at least one weight, b) at least one elongated cord extending in proximity to the guide, the cord being resiliently stretchable and having a lower end retained relative to the base, c) the cord having an upper end portion configured to be lifted with the weight, whereby the cord becomes resiliently stretched to resist such lifting.

The option of cord upper end effective attachment to, or detachment from the weight or weights is typically preserved.

As will be seen, the guide may be provided in the form of an upright housing for the elongated cord, to protect it during cord stretching and unstreching. A second upright housing may be employed, and second resiliently stretchable cord may be provided to extend within the second housing.

Another object is to locate the cords and cord housings proximate transversely spaced portions of a stack of liftable weights, for force balance during lifting.

A yet further object is to provide at least one hook to support a cord end portion; and as will be seen, the hook is typically spaced above the level of the guide, with retention means provided to extend transversely at the upper-end of said at least one weight to support said hook.

An additional object is to improve the already established selectorized strength machines by provision of an accessory as described, and that is easily installed and will provide a use or no use function. The apparatus may have a top bracket that will attach to the selectorized machine and will have a bottom bracket that will attach to the frame or base at the bottom of the machine's weight stack. The cords will run through housings that will attach to the bottom bracket. The housing or housings will terminate just below the top bracket or brackets, storing the cords until they are wanted for use. The cords can be easily utilized by simply attaching them to the top bracket anchor hooks of the upper plate on the selectorized machine. When the cords are not in use, they are conveniently stored in such housings that terminate just below the top bracket's anchor hooks.

Each resiliently stretchable cord will offer a different amount of resistance. Each apparatus can house multiple (for example three) cords. The cords will be different colors to distinguish their different levels of resistance.

It is a further object of the invention to provide a form of resistance that is constant with all weight lifting speeds in the concentric phase of the muscle, i.e. there will be constant force exerted by the stretched cord, even at times of rapid weight load reversal.

It is a further object of the invention to provide progressive resistance to an already established constant resistance provided by the selectorized weight machines.

It is a further object of the invention to provide options in the amount of progressive resistance by offering different amounts and levels of force integrity in the resistance cords.

It is a further object of the invention to provide a practical, inexpensive, accessory to existing selectorized strength machines.

These and other objects and advantages of the invention, as well as the details of an illustrative embodiment, will be more fully understood from the following specification and drawings, in which:

DRAWING DESCRIPTION

DETAILED DESCRIPTION

Figure 1:
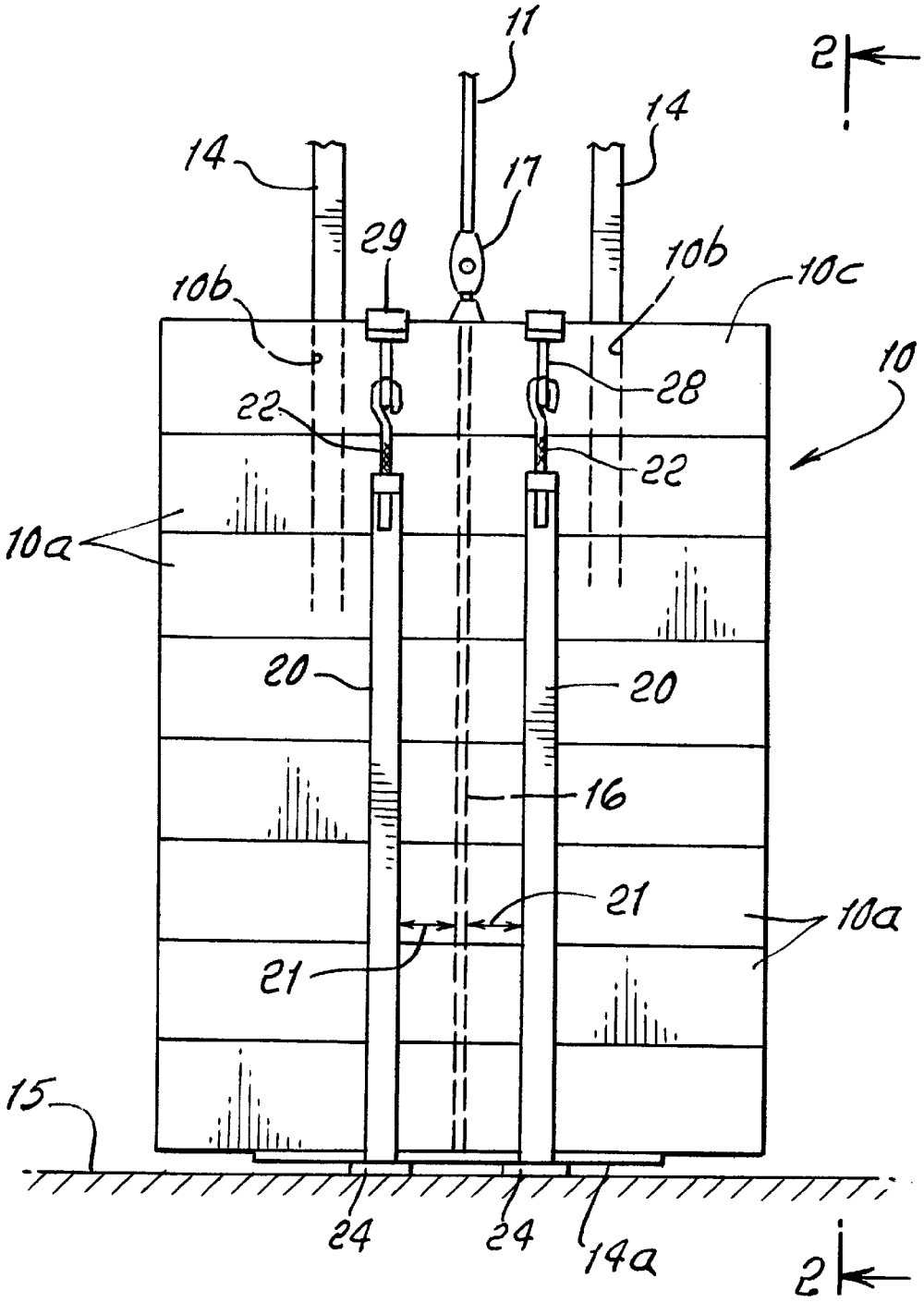
FIG. 1 is a front elevation showing a preferred form of the invention.
Figure 2:
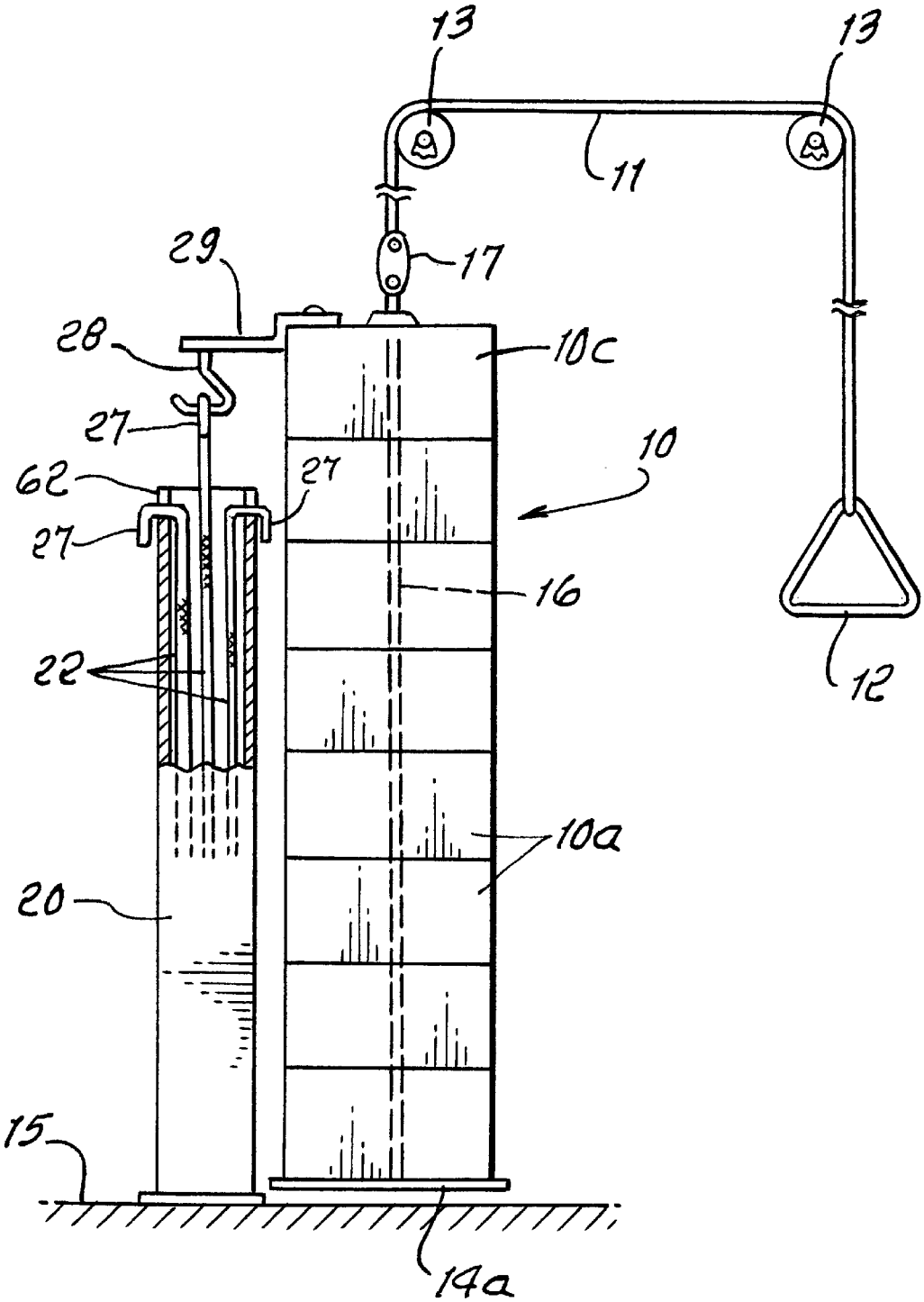
FIG. 2 is a side elevation taken on lines 2—2 of FIG. 1, and showing details of the interior of a cord housing.

In the drawings, a stack 10 of weights 10*a* is adapted to be raised and lowered by a rope or cable 11. A user may grasp and pull at 12 to exert force on the cable, which may pass over rollers 13. The weights extend transversely, and may contain vertical openings 10*b* to pass guide rails 14. The rails extend vertically, and their lower ends are connected to a lateral support 14*a* that supports the weight stack. A connector 16 extends upwardly from the center of the support, and is joined at 17 to the rope or cable, whereby the weight stack may be centrally raised and lowered via force exertion on the rope or cable.

In accordance with the invention, at least one guide is supported by a base 15, and extends upwardly rear or adjacent to the weight stack. At least one elongated cord extends in proximity to the guide, the cord or cords being resiliently stretchable, and having a lower end or ends attached to the guide or guides relative to which the weight or weights are movable. The guide or guides protect the cord during its vertical stretching.

In the example shown, which is preferred, there are two guides 20 that are laterally spaced apart, at opposite sides of the weight centers, the spacings 21 between each guide and the weight vertical center line being equal. The guides are in the form of hollow metallic housings, and at least one and preferably three stretchable cords 22 extends within each housing. See FIGS. 3 and 4. The lower ends of the housings are attached at 24 to the fixed base, and such attachment may be removable.

Figure 3:
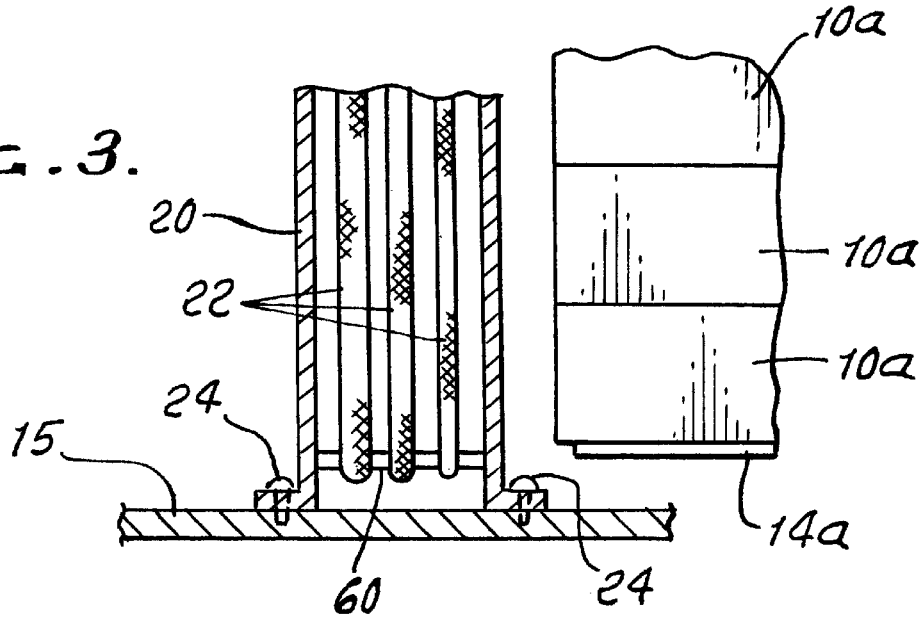
FIGS. 3 and 4 are enlarged elevations taken at upper and lower ends of multiple cords.

The cords have lower end portions attached to the housings within which they are located, or they may be attached to the fixed base. The cords have upper end portions configured to be operatively attached to the weight or weights that move up and down. Accordingly, as the weight or weights are lifted, the cords are resiliently stretched, if they are attached to the weight stack. The cords within each housing typically have different sizes or thicknesses, to provide selectively different resistance to stretch. FIG. 3 shows cord attachments to a bar 60 within a housing.

Figure 4:
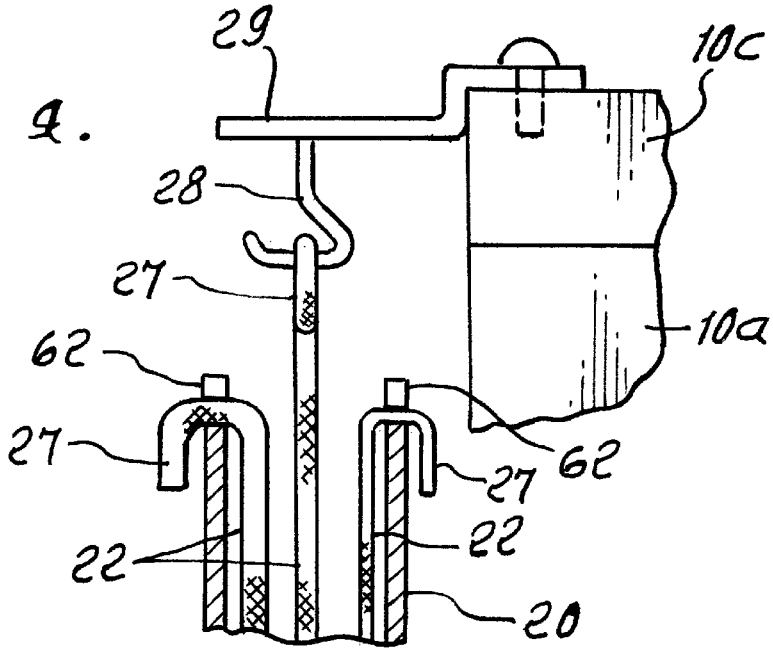

In the example, the upper ends of the cords form loops 27 seen in FIG. 4, and that can be selectively attached to hooks 28 carried by brackets 29 that fit over the top of an upper weight 10*c*. See FIG. 4. If any selected cord is to be used to add resistance to weight lifting, the cord upper end loop is fitted over the hook, whereas if a cord is not to be so used, its looping upper end portion is detached from its hook. In either event, the housing or guide for the cord maintain the cord upright, in untangled condition. The upper end of the cord housing may carry a protrusion 62 or protrussions, on which the cord loop or loops may be fitted when the cord is not attached to a hook.

The cords can be color coded, so that if, for example each housing contains three cords coded red, green and yellow, respectively, and the yellow coded cords have one stretch characteristic, the green coded cords have another stretch characteristic, and the red coded cords have a third stretch characteristic, the user has a wide selection of cords to be used, to obtain a selected or preferred modulated weight lifting characteristics, without needing to change the weights.

I claim:

1. In combination with liftable apparatus, including at least one weight, an assembly comprising a) a base, and at least one generally upright guide supported by the base to extend near said at least one weight, b) multiple selectable cords extending upright in proximity to said at least one guide, said cords being resiliently stretchable and having lower ends retained relative to the base, c) each cord having an upper end portion configured to be lifted with the weight, d) whereby the selected cord becomes resiliently stretched to resist such lifting.

2. The assembly of claim 1 wherein said guide is a first upright housing, and said cord extends within the housing.

3. The assembly of claim 2 wherein said at least one weight comprises a stack of weights, and said housing extends adjacent the stack.

4. The assembly of claim 3 including wherein the guide includes a second upright housing, and a second resiliently stretchable cord extends within the second housing.

5. The assembly of claim 4 including multiple weights in a stack, and said upright housings are located proximate transversely spaced portions of said stack of weights.

6. The assembly of claim 1 wherein there are two of said upright guides and a cord adjacent each guide, said guides laterally spaced apart at opposite sides of the center of mass of said at least one weight.

7. The assembly of claim 1 including weight retention means at a location spaced from said guide, the selected cord being releasably attached to said means.

8. The assembly of claim 1 including at least one hook to support a selected cord upper end portion.

9. The combination of claim 8 wherein said hook is spaced above the level of the guide, and including retention means extending transversely at the upper-end of said at least one weight to support said hook.

10. The combination of claim 1 wherein each cord upper end portion is looped to be releasably attached to structure associated with a weight.

11. The combination of claim 10 wherein the cords have different stretch characteristics.

12. The combination of claim 1 wherein said cords have looping upper end portions to be selectively hung on structure associated with a weight, the cords being color coded.

13. In combination with liftable strength training apparatus, either incorporated in a machine, or as an attachment to an existing machine, where the machine has a movement resistance arm, including at least one weight, an assembly comprising a) at least one generally upright guide supported by a base to extend near said at least one, weight or near said arm, b) multiple upright cords extending in proximity to the guide or guides, each cord being resiliently stretchable and having a lower end retained relative to the base, for resisting lifting movement of said weight or arm, c) each cord having an upper end portion spaced from the guide and configured to be lifted with the weight, or with said arm, d) whereby the cord becomes resiliently stretched to resist such lifting or movement of said arm.

14. The assembly of claim 13 wherein the cord consists of one of the following:

i) rubber tubing ii) an elastic band or bands.

15. The assembly of claim 13 wherein said guide is an upright housing, and said cords have lower portions that extend within the housing.

16. The assembly of claim 15 wherein said at least one weight comprises a stack of weights, and said housing extends adjacent the stack, or adjacent to said arm.

17. The assembly of claim 13 wherein there are at least two of said upright guides or cores adjacent to each guide, said guides laterally spaced apart at opposite sides of the center of mass of said at least one weight or arm.

18. In combination with liftable apparatus, including at least one weight, an assembly comprising a) a base, and at least one generally elongated guide supported by the base to extend near said at least one weight, b) multiple selectable cords extending substantially upright in proximity to said at least one guide, said cords being resiliently stretchable upwardly as said at least one weight is lifted, and having lower ends retained relative to the base, c) each cord having an upper end portion configured to be lifted with the weight, d) whereby the selected cord becomes resiliently stretched to resist such lifting.

19. The assembly of claim 16 wherein said cords extend in parallel relation there being hooks associated with the cords to support an upper end or ends defined by a selected cord or cords, for generally upward stretching.

20. The assembly of claim 16 wherein there are at least two of said cords extending in parallel relation, and having substantially equal length.

* * * * *